US006070871A

United States Patent [19]

Wilson et al.

[11] Patent Number: 6,070,871

[45] Date of Patent: Jun. 6, 2000

[54] BOARD GAME

[76] Inventors: Christopher J. Wilson, 1601 Grace Ave.; Yancey B. Quinn, Jr., 1380 Cove Ave., both of Lakewood, Ohio 44107

[21] Appl. No.: 09/160,262

[22] Filed: Sep. 25, 1998

[51] Int. Cl.[7] ..... A63F 3/02

[52] U.S. Cl. ..... 273/261; 273/260; 273/242

[58] Field of Search ..... 273/236, 242, 273/260, 261, 287

[56] References Cited

U.S. PATENT DOCUMENTS

| | | |
|---|---|---|
| D. 57,430 | 3/1921 | Gore . |
| D. 348,082 | 6/1994 | Seabury . |
| 1,339,013 | 5/1920 | Bennett . |
| 1,704,819 | 3/1929 | Beaman . |
| 3,610,626 | 10/1971 | Nolte . |
| 3,724,856 | 4/1973 | Welch . |
| 3,778,065 | 12/1973 | Hale . |
| 3,920,247 | 11/1975 | Jenkins . |
| 3,941,385 | 3/1976 | Lalley . |
| 3,963,242 | 6/1976 | Treugut et al. . |
| 3,964,747 | 6/1976 | Balmforth . |
| 3,998,464 | 12/1976 | Poturalski . |
| 4,249,741 | 2/1981 | Buijtendorp . |
| 4,580,787 | 4/1986 | Baker . |
| 4,653,759 | 3/1987 | Anderson et al. . |
| 4,940,241 | 7/1990 | Faraci, Jr. . |
| 5,158,302 | 10/1992 | Rewega . |
| 5,209,488 | 5/1993 | Kimball . |
| 5,344,153 | 9/1994 | Watanabe . |

*Primary Examiner*—Jeanette Chapman
*Assistant Examiner*—V K Mendiratta
*Attorney, Agent, or Firm*—Vickers, Daniels & Young

[57] ABSTRACT

A modified chess game for two or three players with a hexagonal game board having six sides and 169 hexagonal spaces. Each of the six sides including eight spaces adjacent to one another in an edge row such that the first space and the eighth space are shared with an adjacent edge row. The 169 spaces contain one of three distinctly different space indicia, and are arranged such that no two adjacent spaces have the same space indicia.

24 Claims, 4 Drawing Sheets

CAPTURE & MOVE

BOARD GAME

BACKGROUND OF THE INVENTION

This invention relates to the art of chess games and, more particularly, to an improved three player chess game in which the pieces of each set of game pieces are initially positioned adjacent to a different side of a game board having hexagonal spaces and six sides.

Modified chess games designed for play by three players are known in the art, but these games fail to maintain the true feel of a traditional chess game while allowing effective engagement of two opponents. This is a result, in part, of the configuration of the chess board which restricts the movements of the game pieces. In this respect, some prior art game boards require the game pieces to be initially set up unconventionally, thereby, restricting the initial moves of the game pieces at the start of the game. Initial movements are restricted by the initial position of one game piece blocking a move of other game pieces or by the number of spaces between the opponents' game pieces preventing a traditional opening move strategy. Moreover, some disclosed game boards have configurations and layouts which inhibit simultaneous engagement with two opponents. Simultaneous engagement requires the game pieces to have the ability to effectively shift their engagement from one opponent to the other opponent. If too many game pieces become committed to engaging with one opponent, an offensive move by the other opponent cannot be effectively addressed by those pieces. As a result, the game pieces of each opponent become separated into two distinct groups which separately engage each opponent, thereby, restricting multiple piece strategies as found in a traditional chess game. Furthermore, some of the prior game boards restrict the movement ability of the game pieces by having an undesirable game space shape or and undesirable ratio between open spaces and occupied spaces. Too many or too few open spaces require unconventional moves to engage the opponents and inhibit simultaneous engagement.

The Rewega U.S. Pat. No. 5,158,302 (hereinafter "the '302 patent") discloses a three player chess game comprising a truncated triangular game board on which the game pieces are initially positioned unconventionally. While traditional chess games have the game pieces set up in two rows, the '302 patent discloses a chess game where the game pieces are set up in three rows at the truncated corners of the board. The '302 patent also discloses less pawns than a traditional chess game. This unconventional set-up creates restrictions in the initial moves of the game pieces. Furthermore, the reduced number of pawns and limited open spaces of the game board reduce the number of potential moves during the chess game. As a result, the '302 patent discloses a chess game that fails to play and have the same feel as a traditional chess game.

The Anderson, et al U.S. Pat. No. 4,653,759 (hereinafter "the '759 patent") also discloses a three player chess game. The '759 patent discloses three conventional spaced game boards which are combined by a common central triangular game board section. Even though the '759 patent discloses a game board that allows the game pieces to be set up in the standard positions, the disclosed game board does not allow a three player chess game to have the feel of a traditional two player chess game. In a traditional two player chess game, the initial moves of each player position game pieces, normally pawns, to allow engagement and capture of opposing game pieces. By separating the three chess boards with a common triangular board section, multiple moves are required before game pieces are allowed to engage an opposing game piece. In addition, the game board in the '759 patent reduces the ability to engage both opponents simultaneously. Once a game piece has been committed to engaging one opponent, that game piece will no longer be in an effective position to engage the game pieces of the second opponent. Therefore, the '759 patent discloses a three player chess game which does not play similar to that of a traditional chess game, nor does it disclose a chess game that allows effective three player engagement.

The Faraci U.S. Pat. No. 4,940,241 (hereinafter "the '241 patent") discloses a three player chess game which utilizes a triangular game board with triangular spaces. Furthermore, the game board includes three separate and individual starting positions for the individual game pieces of each player outside the triangle and along the sides thereof This set up will shield the game pieces from the opponents' game pieces and minimize their initial movements, thereby, reducing the feel of a traditional chess game. The use of triangular spaces creates a chess game that has a different feel than that of a traditional chess game. This is a result of the reduced number of directions for movement due to the triangular spaces. Effective engagement of both opponents requires a higher degree of move potential than is allowed with triangular spaces. Another factor is the elimination by Faraci of the knight game piece. Knights are an important element of the traditional game of chess, and their elimination further reduces the traditional feel of the game.

The Treugut, et al U.S. Pat. No. 3,963,242 (hereinafter "the '242 patent") discloses a three player chess game having a six sided game board utilizing triangular spaces. As with the '241 patent, the triangular spaces of this game board restrict the degree of movement required to create the feel of a traditional chess game when three players engage in the game of chess.

The Hale U.S. Pat. No. 3,778,065 (hereinafter "the '065 patent") discloses a chess game including a truncated triangular game board and playing surface utilizing hexagonal spaces, but again the disclosed chess game lacks the feel of a traditional chess game. The traditional "feel" is lost for a number of reasons. First, a player's bishops are not capable of engaging either opponents' bishops. This is a result of the initial set up of the bishop and its movement. The bishops are initially positioned flanking the king and queen, both bishops being on game spaces of the same color, either white, red or black. Furthermore, each player's bishops are initially positioned on game spaces of a different color from that of the bishops of the other two players. In this respect, the white player's bishops are on white spaces, the red player's bishops are on red spaces, and the black player's bishops are on black spaces. Therefore, based on the movement of a bishop, which results in the bishops remaining on spaces of the same color, this set up creates a game in which the bishops of one player are not capable of engagement and capture of the bishops of either opponent, thereby failing to create the feel of a traditional chess game. Second, the '065 patent discloses a game board in which three of the six sides contain eight game spaces, while the remaining three sides merely contain six spaces. This game board configuration reduces the traditional chess game feel in two aspects. First, the outer pawns of each player are initially disposed such that they can be as close as two spaces from a pawn of both opposing players. Second, the ratio between open spaces and occupied spaces is reduced, thereby, not allowing the traditional two player move strategies.

The Jenkins U.S. Pat. No. 3,920,247 (hereinafter "the '247 patent") discloses a chess game which utilizes a hexagonal game board and spaces, but it is restricted by its size. The '247 patent discloses only seven spaces per side of the game board. As with the '065 patent, a game board with only seven spaces per side reduces the traditional chess game feel by restricting movement of the game pieces caused by the reduction in the ratio between open spaces and occupied spaces. Furthermore, due to the size of the game board, the game pieces must be initially positioned in an unconventional manner. In this respect, the '247 patent discloses the game pieces set up in the comers of the game board, not on the sides, thereby restricting initial movements of the game pieces. In addition, only seven pawns are used, as opposed to the traditional eight pawns of a two player chess game. The result is a chess game which fails to play and have the feel of a traditional chess game.

The Baker U.S. Pat. No. 4,580,787 (hereinafter "the '787 patent") discloses a three player game board, having nine spaces per side. This results in a game board having 217 spaces, thereby, creating too large of a ratio between open spaces and occupied spaces. This reduces traditional chess game feel by requiring an undesirable number of moves before capturing an opposing player' game pieces. Furthermore, having a large number of spaces on the board restricts a player's opportunity to have simultaneous engagement with both opponents by requiring multiple moves before some game pieces can shift from engaging one opponent to engaging the other opponent.

By utilizing triangular spaces, the movements of the game pieces are limited and simultaneous engagement with the opposing players is difficult. Utilizing hexagonal playing spaces solves some of the movement problems of the game pieces, but creates problems with respect to the bishops. In this respect, based on the standard movement of the bishop, the bishop will remain on spaces of the same color when three colors are used to differentiate the spaces on the board. As a result, the use of two bishops both initially positioned on one color, which is different for each player, reduces the traditional chess game feel by not allowing the bishops of one player to engage the bishops of the opposing players. In an attempt to solve this problem, prior art has utilized three bishops, but the disclosed use of three bishops fails to solve the problem due to the unconventional initial positioning of the game pieces required by the board configuration. The result is the restricted and unconventional initial move capabilities of the disclosed bishops reducing the feel of a traditional chess game. Furthermore, this unconventional initial configuration prevents bishops from being moved until multiple movements of other game pieces are made, further reducing the traditional feel of the chess game by requiring multiple unconventional moves before the bishops can be utilized. Another problem associated with engaging two opponents simultaneously is the limited movement ability of the pawns. The prior art does not disclose pawns that are able to effectively engage both opponents simultaneously. As disclosed, by restricting pawns to only forward movements, pawns are limited to effective engagement with only one opponent. By only moving forward, the pawns have only limited ability to retreat and engage the second opponent. Furthermore, by utilizing a game board which requires a reduction in the number of pawns per set of game pieces accentuates the problem of simultaneous engagement by the pawns. When engaging two opponents, a reduced number of pawns limits the ability to engage both opponents by restricting the number of forward-move-only pawns which can be committed to engage each opponent separately.

An improper ratio between open spaces and occupied spaces reduces the traditional chess game feel in many ways. When the number of open spaces is too large, too many moves are required to engage both of the opponents. Furthermore, simultaneous engagement between both opponents is restricted. Once a game piece has been committed to engage one opponent, many moves may be required to use that same piece against the second opponent. Conversely, too few open spaces limit the movement ability of some game pieces and reduce multiple move strategies. Therefore, a chess game with the optimal open space ratio allows simultaneous engagement with two opponents and allows strategic multiple moves, thereby, maintaining the feel of a traditional two player chess game with a three player chess board.

Therefore, it will be appreciated that the prior art relating to three player chess games fails to create a chess game that allows three players to play simultaneously without sacrificing the feel of a traditional chess game, both with respect to traditional moves of the game pieces and the size of the playing field, provided by the game board and its configuration. In this respect, prior art such as that disclosed above, disclose three player chess games which do not have the optimal number and type of game pieces that are capable of traditional movements. Furthermore, they do not disclose a game board with a configuration and a ratio of open spaces to occupied spaces that creates substantially the same feel as a traditional two player chess game.

SUMMARY OF THE INVENTION

In accordance with the present invention, a three player chess game is provided which plays like a traditional chess game and has more of the feel of a traditional chess game than three player chess games heretofore available. This is accomplished by providing a six sided game board which allows all of the traditional game pieces to be used and initially aligned in the first two rows on one of the six sides of the game board, and which allows for an optimal ratio between open game spaces and occupied game spaces in the playing field. Furthermore, in accordance with the present invention, a three player chess game is provided by which playing enjoyment is enhanced by providing a game board and open space ratio by which a player is able to simultaneously engage two opponents.

Utilizing a hexagonal game board, with hexagonal spaces and eight spaces per side, allows the game pieces to be set up in substantially the traditional configuration. In this respect: two rooks, two knights, two bishops, a queen and a king can be initially positioned on spaces in the edge row as in a two player chess game. The traditional eight pawns can be positioned in the second row. By having the traditional game pieces initially positioned on spaces in the first two rows, knights are able to move from the start without movement of a pawn. The bishops, rooks, queen, and king are able to be moved after a single movement of a pawn. Furthermore, this conventional two row set-up of the game pieces allows many of the traditional two player strategies to be utilized.

By utilizing a game board in accordance with the present invention, three players are able to engage in a three player chess game which plays and feels more like a traditional two player chess game. As a result, a three player chess game in accordance with the present invention allows use of traditional chess strategies, thereby, creating a more enjoyable and challenging chess game. The use of hexagonal spaces allows the game pieces to move similar to that of a game piece of a traditional two player chess board. The hexagonal spaces also allow effective engagement of both opponents by allowing the optimal range of movement by the game pieces. Furthermore, the game board in accordance with the present invention, includes a ratio between open spaces and occupied spaces which allows for multiple move strategies to be utilized and allows for effective simultaneous engagement of both opponents.

In addition, a game board in accordance with the present invention allows effective use of special game pieces required to further increase the traditional feel of a three player chess game. First, the game board allows effective initial positioning of the three bishops. Two bishops are initially positioned on spaces in the edge row as in a traditional two player chess game. The third bishop is positioned on a space in the second row, but it is able to be positioned so as to minimize the restrictions on the initial movements of the game pieces in the edge row. Furthermore, the three bishops can be initially positioned so that one bishop is on each of the three different space indicia. Therefore, each player is capable of engagement and capture of bishops of an opposing player. In addition, the movement of standard pawns reduces their effectiveness in a three player chess game, because traditionally they are only able to move in the forward direction, thereby, limiting the ability to retreat and engage the other opponent.(By including special "elite" pawns, which may move in all directions one adjacent space, a player can easily disengage an "elite" pawn from engagement with one opponent and move it into engagement with the other opponent. As a result, the "elite" pawns allow a player to effectively engage both opponents simultaneously by having the ability to engage one opponent and fight off the engagement of the other opponent. The elite pawns also allow two of the eight pawns to be initially positioned in a third row, thereby, allowing initial moves which cordon the game board into three equal territories which facilitates the use of traditional two player chess game strategies.

It is accordingly an outstanding objective of the present invention to provide an improved three player chess game.

A further objective is to provide a three player chess game that plays and feels more like that of a traditional two player chess game than that of a three player chess games heretofore available.

Yet, a further objective is to provide a three player chess game which allows a player to have a more effective engagement with both opponents simultaneously than heretofore possible.

Still, a further objective is to provide a chess game board for a three player chess game which allows standard game pieces to be initially positioned similar to that of a traditional chess game.

Yet, another objective is to provide a three player chess game which allows for the effective use of traditional game pieces.

Still, another objective is to provide a three player chess game which has a more desirable ratio between open spaces and occupied spaces than provided by such games heretofore available.

Yet, a further objective is to provide a three player chess game which is more interesting, challenging, and enjoyable than three player chess games heretofore available.

BRIEF DESCRIPTION OF THE DRAWINGS

The foregoing objects, and others, will in part be obvious and in part pointed out more fully hereinafter in connection with the written description of an embodiment of the invention illustrated in the accompanying drawings in which.

DESCRIPTION OF THE PREFERRED EMBODIMENTS

Figure 1:
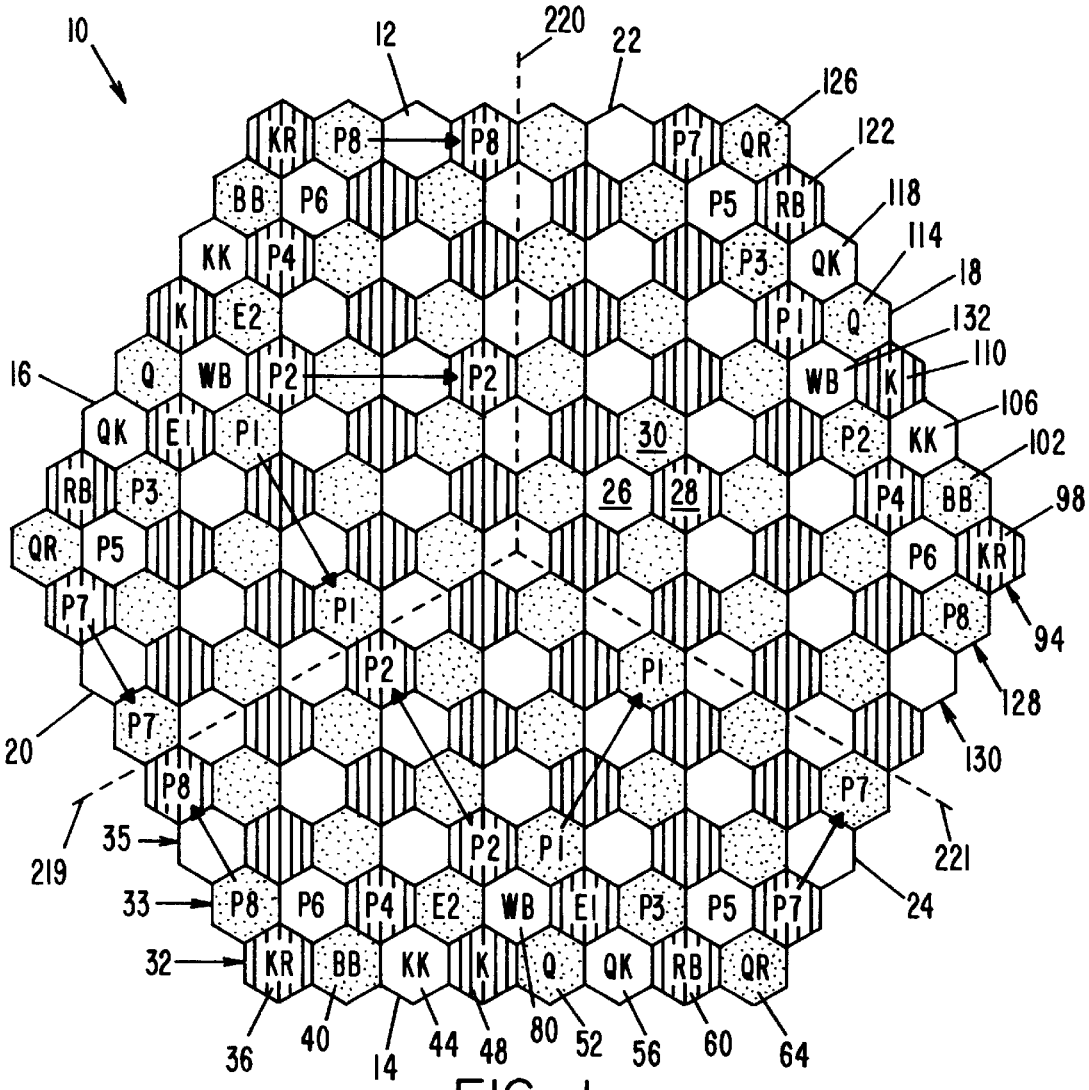
FIG. 1 is a plan view of the game board of the present invention showing the alignments of game pieces in the opening position.

Referring now to the drawings, wherein the showings are for the purpose of illustrating a preferred embodiment of the invention only and not for the purpose of limiting the invention, the figures show a three player chess game. In FIG. 1, game board area 10 is depicted as having a plurality of hexagonal playing spaces 12 of uniform size and positioned relative to one another such that they form a six sided game board having eight spaces along each side. Three of the six sides include the game pieces of each player at the beginning of the game. This is shown in FIG. 1 by first side 14, third side 16, and fifth side 18 being set up with the game pieces even though second side 20, fourth side 22, and sixth side 24 could be utilized.

Game spaces 12 have three distinctly different game space indicia such as the colors white, red, and black which are represented by white spaces, striped spaces and shaded spaces. The first space indicia 26 is shown in FIG. 1 by a white space without any shading or stripes and represents a white space. Second space indicia 28 is shown in FIG. 1 by vertical lines and represents a red space. The third space indicia 30 is shown in FIG. 1 by shading and represents a black space.

The game pieces are represented in FIG. 1 by letter code; "KR" representing the king side rook, "BB" representing the black bishop, "KK" representing the king side knight, "K" representing the king, "Q" representing the queen, "QK" representing the queen side knight, "RB" representing the red bishop, "QR" representing the queen side rook, "WB" representing the white bishop, "P" representing the pawns, and "E" representing elite pawns.

FIG. 1 shows one set-up of the game pieces on first side 14; the first row 32 of first side 14 including eight spaces 36,40,44,48,52,56,60,64; second row 33 of first side 14 including nine spaces; and third row 35 of first side 14 including ten spaces. It should be noted that the initial setup up of each player's game pieces is the same. The preferred initial set-up of each player's game pieces is shown on first side 14, such that the king side rook KR is initially positioned on first space 36 of first row 32. Black bishop BB is initially positioned on second space 40 adjacent to first space 36 in first row 32. King side knight KK is initially positioned on third space 44 adjacent to second space 40 of first row 32.

The king K is initially positioned on fourth space 48 adjacent to third space 44 of first row 32. The queen Q is initially positioned on fifth space 52 which is adjacent to fourth space 48 in first row 32. The queen side knight QK is initially positioned on sixth space 56 which is adjacent to fifth space 52 in first row 32. The red bishop RB is initially positioned on seventh space 60 which is adjacent to sixth space 56 in first row 32. The queen side rook QR is initially positioned on eighth space 64 which is adjacent to seventh space 60 in first row 32. Second row 33 includes nine spaces and the game pieces are initially positioned such that the fourth pawn P4, sixth pawn P6, and eighth pawn P8 are initially positioned adjacent to one another in the first three spaces of second row 33. Third pawn P3, fifth pawn P5, and seventh pawn P7 are initially positioned in second row 33 adjacent to one another on the last three spaces. Second row 33 includes a center space 80 and white bishop WB is initially positioned thereon. Elite pawns E1 and E2 are initially positioned in second row 33 flanking white bishop WB. Pawns P1 and P2 are positioned in third row 35 adjacent to white bishop WB.

Figure 2:
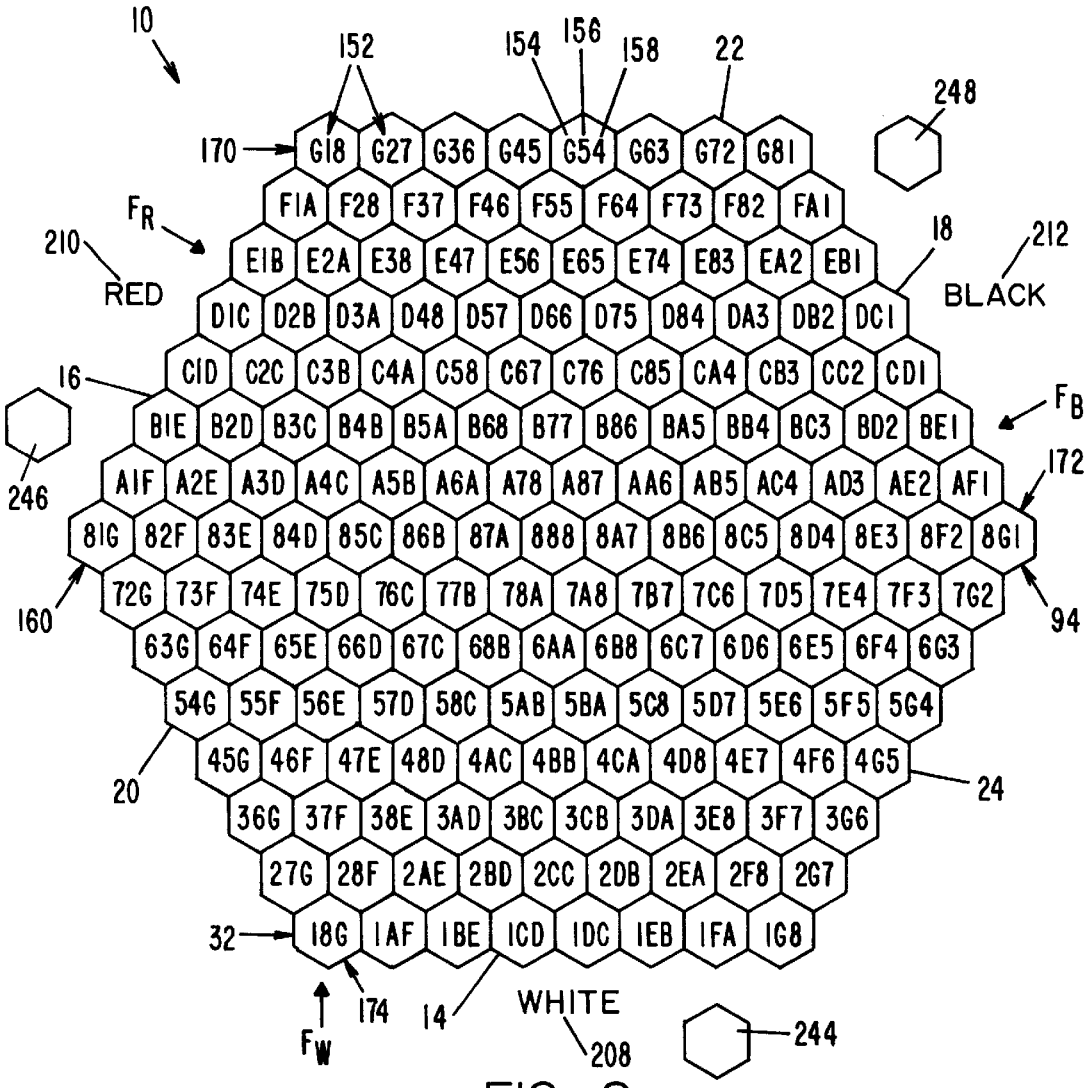
FIG. 2 is a plan view of the game board of FIG. 1 showing the hex spaces location designators.

Referring to FIG. 2, game spaces 12 have been assigned space designators 152. These designators allow players who are playing in different locations to communicate moves by telephone, computer or while on the Internet. In addition, these designators can be used for setting up electronic versions of the game. The designators can either be placed directly on the game board area 10 or they can be printed separately. Each space designator 152 includes three elements: first element 154, second element 156, and third element 158 which communicate the position of each space of the game board area 10 in relation to three sides of the game board area 10. When the three elements are combined, the exact position of the space can be determined. As with the initial positioning of the game pieces, the three elements 154, 156, and 158 of space designator 152 can be based on first side 14, third side 16, and fifth side 18; or they can be based on second side 20, fourth side 22, and sixth side 24. Referring to FIG. 2, shown is a space designator 152 based on first side 14, third side 16, and fourth side 18. Each element 154, 156 and 158 representing the number of rows the particular space is away from three of the six edge rows. As shown in FIG. 2, a combination numeric and alphabetic code is used, the code being numeric for the first eight rows; the edge row being row "1," namely, first row 32 of first side 14, first row 160 of third side 16, and first row 94 of fifth side 18. The code being alphabetic to represent the remaining seven rows, such that first element 154, second element 156, and third element 158 use a letter code to signify the last or fifteenth rows 170, 172, and 174 of sides 14, 16, and 18 respectfully. The use of a combination numeric and alphabetic code makes locating the actual space on the game board area 10 easier by creating numeric sections and alphabetic sections. It will be appreciated that the code represented in FIG. 2 is just one of many potential codes for elements 154, 156, and 158.

Figure 3:
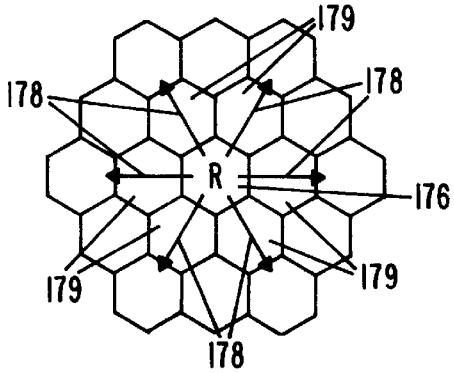
FIG. 3 is a plan view of a segment of the game board illustrating the movements of a rook game pieces.

Referring to FIG. 3, shown is the potential moves of the rook R which can capture and move laterally as shown by arrows 178 towards one of the adjacent spaces 179. This move can extend until another game piece in encountered. If the latter is an opponent's game piece, it is captured in the manner of a traditional chess game. The rook R may not jump another game piece while making one of the moves shown by arrows 178. As with traditional two player chess, a single move by a pawn, namely, pawn P7 or P8 can expose a rook R to attack by another player' rook R, thereby, further creating the feel of a traditional chess game.

Figure 5:
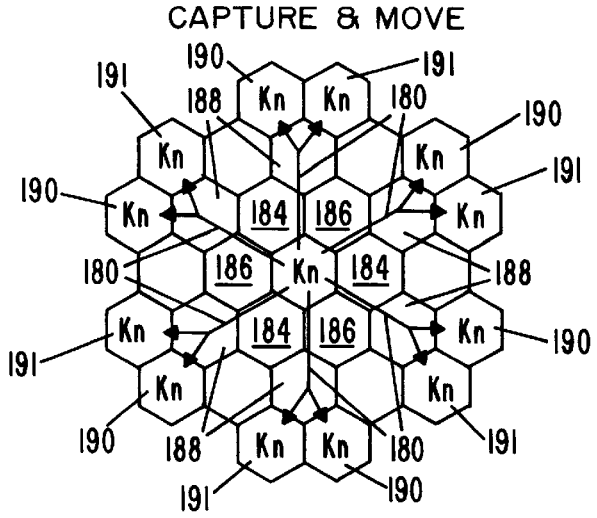
FIG. 5 is a plan view of a segment of the game board illustrating the movements of a knight game piece.

Referring to FIG. 5, shown is the potential moves of the knight Kn. Knight Kn can move laterally in the direction of arrows 180 between one of the sets of two adjacent spaces 184, 186 to a space 188, across the latter and then laterally onto one of the spaces 190 or 191 adjacent to space 188.

Figure 6:
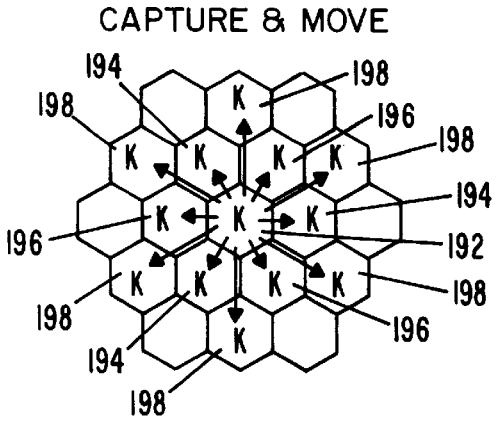
FIG. 6 is a plan view of a segment of the game board illustrating movements of a king game piece.

Referring to FIG. 6, depicted is the movement of king K. King K can move and capture another game piece either diagonally or laterally, but it can only move one space per turn. King K can move and capture laterally by moving from initial space 192 to one of adjacent spaces 194 or 196, or king K can move and capture diagonally by moving diagonally from initial space 192 between one of spaces 194 and 196 to one of diagonal spaces 198.

Figure 7:
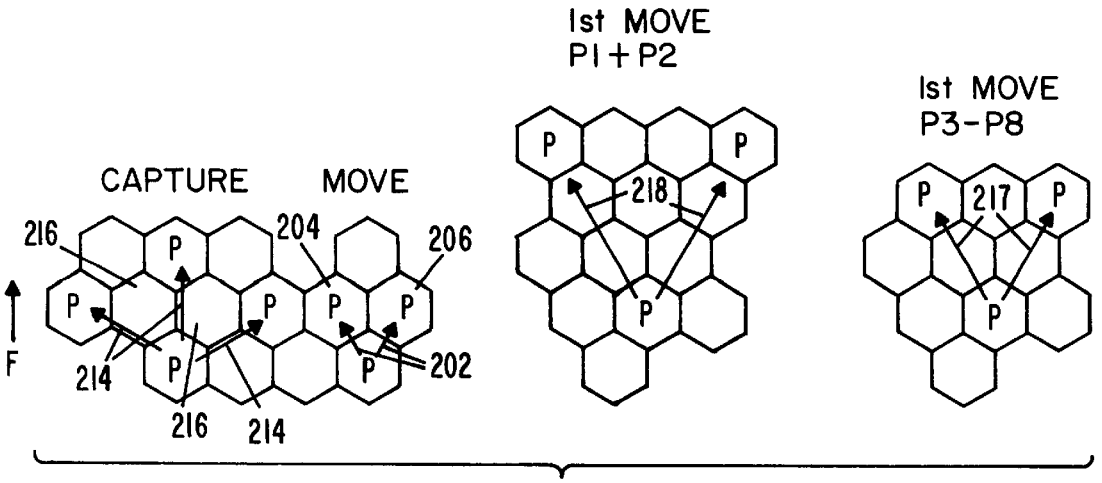
FIG. 7 is a plan view of a segment of the game board illustrating movements of a pawn game piece.

Referring to FIG. 7, depicted are the movements of a pawn P. Pawn P may move laterally in forward direction F as indicated by arrows 202 one space to adjacent spaces 204 or 206, or capture an opponent's game piece by moving diagonally forward as indicated by arrows 214 past adjacent spaces 216. The determination of a forward move is based on the position of the player 208, 210, and 212 with each player having a different forward direction as represented by $F_W$, $F_R$ and $F_B$ in FIG. 2. White player 208 has a forward direction $F_W$ corresponding to first element 154. A forward move by white player 208 will result in first element 154 increasing. A forward move $F_R$ for red player 210 will result in an increase of second element 156. A forward move $F_B$ for black player 212 will result in an increase in third element 158. FIG. 7 further shows a first move potential for pawn P to allow the play and feel of a traditional chess game. In this respect, pawn P1 and P2 are allowed to move three adjacent spaces in the forward direction F along one of lines 218 during their first move of the game. In addition, pawns P3–P8 are allowed to move two adjacent spaces in the forward direction F along one of lines 217 during their first move of the game. Subsequent moves are restricted to the forward lateral moves indicated by arrows 202 of one adjacent space. These special first moves by pawns P allow for the creation of clearly defined territories by each of the players 208, 210, and 212 as is shown in FIG. 1 by hidden lines 219, 220 and 221. The ability to establish clearly defined and equally balanced territories add to the traditional two player feel of the game by allowing the use of traditional chess strategies. In addition, the ability of pawn P2 and pawn P8 of player 208 to stand off with pawn P1 and pawn P7 of player 210 respectively in one move further increases the play and feel of a traditional chess game. It should be noted that this move can be performed equally by all three players. As in a traditional chess game, a pawn which penetrates the first row of an opponent's side is transformed to a queen Q game piece, thereby, allowing movement and capture of other game pieces in the same way as a queen Q game piece.

Figure 8:
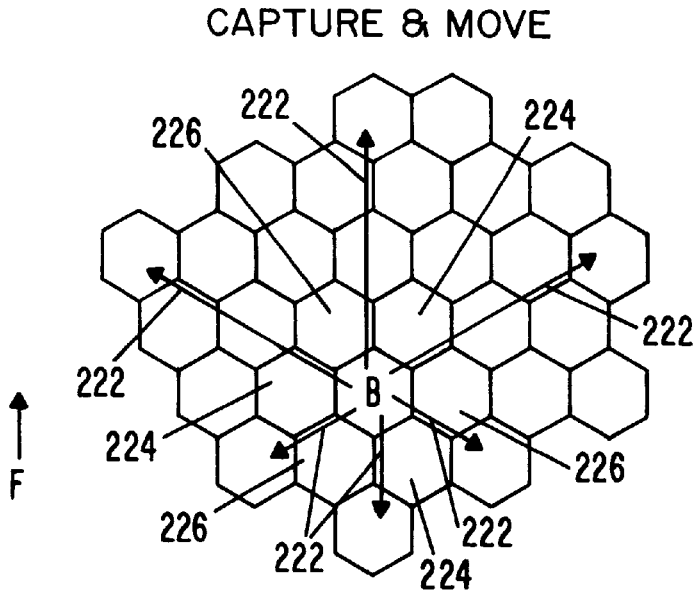
FIG. 8 is a plan view of a segment of the game board illustrating the movements of a bishop game piece.

FIG. 8 depicts the potential move of bishop B. Bishop B can both move and capture diagonally along any one of move lines 222 such that it moves between adjacent spaces 224 and 226, but the bishop's movement is restricted by other game pieces. In this respect, bishop B cannot move diagonally past two game pieces on adjacent spaces such as game pieces on spaces 224 and 226. Bishop B also cannot jump a game piece along the diagonal path shown by move lines 222.

Figure 9:
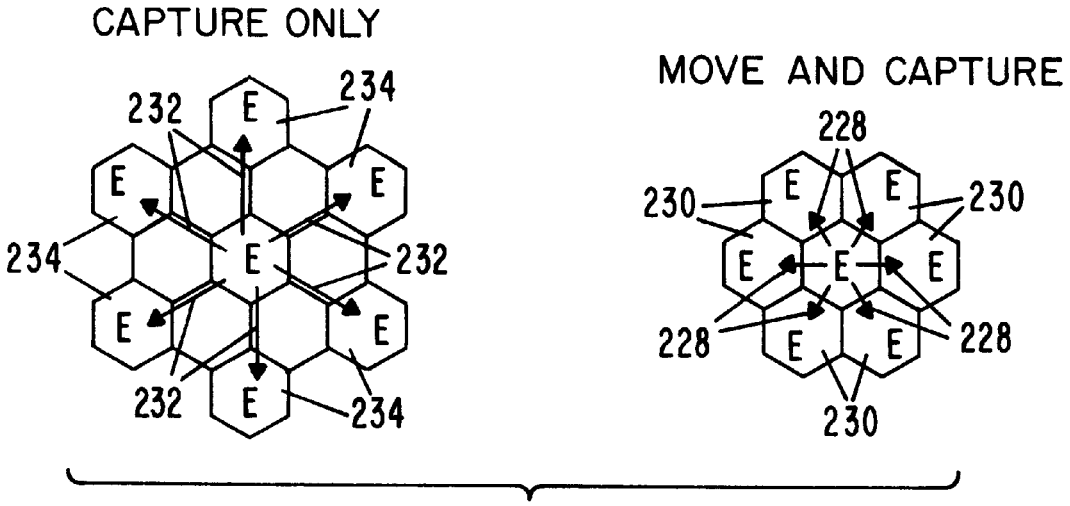
FIG. 9 is a plan view of a segment of the game board illustrating the movements of a special elite pawn game piece.

FIG. 9 depicts the potential movements and capture of elite pawn E. Elite pawn E can move and capture like a traditional pawn P, but can move and capture in all directions. In this respect, elite pawn E may move laterally in one of the directions as shown by move lines 228 to one of the adjacent spaces 230. Elite pawn E can capture both laterally and diagonally in all directions as shown by move lines 232 and diagonal spaces 234, and move lines 228 to adjacent spaces 230. Referring to FIG. 1, the location of the elite pawn E flanking white bishop WB strengthens the lines of defense to allow for better protection of the bishops as used in connection with pawns P. This is partially due to the initial positioning of the elite pawn E and the ability of the elite pawn E to move and capture in all directions.

Referring back to FIG. 2, the "chexs" spaces 244, 246 and 248 are used to designate a player's turn. The three "chexs" spaces 244, 246 and 248 are positioned outside of game board area 10. The first "chexs" space 244 is positioned along first side 14, and when it is the white player's 208 turn to move, a move indicia is placed in the white player's 208 "chexs" space 248. When the white player 208 has completed their move, the move indicia is moved to red player's 210 "chexs" space 246 and released. Black player 212 has a "chexs" space 244 which is positioned by fifth side 18. A player's move is not complete until the move indicia is positioned on the next player's "chexs" space and the player releases all contact from the move indicia.

Figure 4:
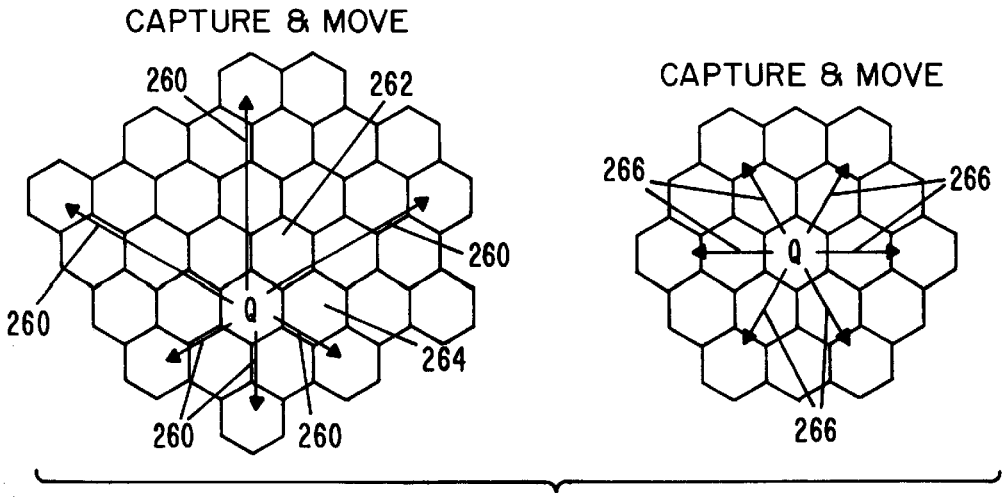
FIG. 4 is a plan view of a segment of the game board illustrating the movements of a queen game piece.

Referring to FIG. 4, shown is the potential movements of queen Q. Queen Q can both capture and move in the same way as bishop B and rook R. More particularly, queen Q can move and capture diagonally in the direction shown by arrows 260. As opposed to bishop B, queen Q can move through adjacent intervening game pieces, such as game pieces on spaces 202 and 204, along the move shown by arrows 260. Queen Q can also move and capture laterally in the direction shown by arrows 266.

Shown in FIG. 1, on third side 18, is an alternate set up of the game pieces. Again, it should be noted that the initial set-up of each player's game pieces is the same and that the set-up shown at third side 18, if utilized, would be utilized by all three players. In first row 94 the game pieces are set up in the same position as shown on first side 14. Namely, king side rook KR is initially positioned on first space 98 of first row 94, black bishop BB is initially positioned on second space 102 of first row 94, king side knight KK is initially positioned on third space 106 of first row 94, king K is initially positioned on fourth space 110 of first row 94, queen Q is initially positioned on fifth space 114 of first row 94, queen side knight QK is initially positioned on sixth space 118 in first row 94, red bishop RB is initially positioned on seventh space 122 in first row 94, queen side rook QR is initially positioned on eighth space 126 of first row 94. The differences in this alternative set-up, as represented on third side 18, are in the initial positions of the game pieces in second row 128 and in the elimination of initially positioned game pieces in third row 130. Second row 128 includes a central space 132. White bishop WB is initially positioned on central space 132, while pawns P1–P8 are positioned on the remainder of spaces of second row 128 flanking white bishop WB.

While considerable emphasis has been placed on the preferred embodiments of the invention illustrated and described herein, it will be appreciated that other embodiments can be made and that many changes can be made in the preferred embodiments without departing from the principals of the invention. Accordingly, it is to be distinctly understood that the foregoing descriptive matter is to be interpreted merely as illustrative of the invention and not as a limitation.

Having thus described the invention, it is claimed:

1. A modified chess game for two or three players which comprises a hexagonal game board having six sides and exactly 169 hexagonal spaces, each of said six sides including eight of said spaces adjacent to one another in an edge row such that a first space and an eighth space of said edge row are shared with adjacent edge rows, each of said spaces having one of three distinctly different space indicia, and said spaces being arranged such that no two adjacent spaces have the same said space indicia, said game further including at least two sets of game pieces bearing set indicia indicative of membership in a respective one of said at least two sets, each set comprising eight pawns, a first bishop, a second bishop, a third bishop, two knights, two rooks, a king and a queen, wherein said three space indicia includes a first space indicia, a second space indicia, and a third space indicia, and said first bishop includes indicia similar to said first space indicia, said second bishop includes indicia similar to said second space indicia, and said third bishop including indicia similar to said third space indicia.

2. The chess game according to claim 1, wherein said space indicia are visually distinct colors.

3. The chess game according to claim 1, wherein said each set further comprises a plurality of elite pawns, said elite pawns having visible elite pawn indicia visible to all players of the chess game.

4. The chess game according to claim 3, wherein said space indicia are visually distinct colors.

5. The chess game according to claim 3, wherein said each set includes only two said elite pawns.

6. The chess game according to claim 5, wherein said space indicia are visually distinct colors.

7. The chess game according to claim 3, wherein said visible elite pawn indicia includes a visually distinct shape.

8. The chess game according to claim 3, wherein said visible elite pawn indicia includes a visually distinct color.

9. A modified chess game for two or three players which comprises a hexagonal game board having six sides and exactly 169 hexagonal spaces, each of said six sides including eight of said spaces adjacent to one another in an edge row such that a first space and an eighth space of said edge row are shared with adjacent edge rows, each of said spaces having one of three distinctly different space indicia, and said spaces being arranged such that no two adjacent spaces have the same said space indicia, said game further including at least two sets of game pieces bearing set indicia indicative of membership in a respective one of said at least two sets, each set comprising eight pawns, three bishops, two knights, two rooks, a king, a queen and only two elite pawns, said elite pawns having visible elite pawn indicia visible to all players of the chess game.

10. The chess game according to claim 9, wherein said visible elite pawn indicia includes a visually distinct shape.

11. The chess game according to claim 10, wherein said space indicia are visually distinct colors.

12. The chess game according to claim 9, wherein said visible elite pawn indicia includes a visually distinct color.

13. The chess game according to claim 12, wherein said space indicia are visually distinct colors.

14. The chess game according to claim 9, wherein said space indicia are visually distinct colors.

15. A hexagonal game board for playing a modified chess game comprising six sequentially adjacent sides including a first side opposite a fourth side, a second side adjacent said first side and opposite a fifth side, and a third side adjacent said second side and opposite a sixth side; hexagonal spaces forming a plurality of parallel rows adjacent one another in a first row direction, a second row direction and a third row direction; said plurality of rows in said first row direction beginning with a first edge row adjacent to and parallel with said first side and ending with a fourth edge row adjacent to and parallel with said fourth side, said plurality of rows in said second row direction beginning with a third edge row adjacent to and parallel with said third side and ending with a sixth edge row adjacent to and parallel with said sixth side, said plurality of rows in said third row direction beginning with a fifth edge row adjacent to and parallel with said fifth side and ending with a second edge row adjacent to and parallel with said second side; said game board further comprising a space designator to establish the location of each space of said spaces relative to said first, third and fifth sides; said space designator comprising a first, second and third element wherein said first element relates to the number of rows in said first row direction from said first side, said second element relates to the number of rows in said second row direction from said third side, and said third element relates to the number of rows in said third row direction from said fifth side.

16. The game board of claim 15, wherein said first, second and third elements include at least one numeric character and at least one letter character.

17. The game board of claim 16, wherein said plurality of rows in said first, second and third row direction include a center row, and said first, second and third elements being said at least one numeric character on one side of said center row and said at least one letter character on the other side of said center row.

18. The game board of claim 17, wherein said plurality of rows is exactly fifteen rows in each of said first, second and third row directions and said first, second and third elements begin with a number one and sequentially increase such that said center row is a number eight; said first, second and third element being a letter A at a ninth row of said plurality of rows and sequentially increasing alphabetically such that said fifteenth row is a letter G.

19. The game board of claim 18 further comprising exactly 169 said hexagonal spaces, each of said edge rows including eight of said spaces adjacent to one another such that a first space and an eighth space of said edge rows are shared with adjacent edge rows, each of said spaces having one of three distinctly different space indicia, and said spaces being arranged such that no two adjacent spaces have the same said space indicia.

20. The game board of claim 19, wherein said space indicia are visually distinct colors.

21. The game board of claim 17 further comprising exactly 169 said hexagonal spaces, each of said edge rows including eight of said spaces adjacent to one another such that a first space and an eighth space of said edge rows are shared with adjacent edge rows, each of said spaces having one of three distinctly different space indicia, and said spaces being arranged such that no two adjacent spaces have the same said space indicia.

22. The game board of claim 21, wherein said space indicia are visually distinct colors.

23. The game board of claim 15 further comprising exactly 169 said hexagonal spaces, each of said edge rows including eight of said spaces adjacent to one another such that a first space and an eighth space of said edge rows are shared with adjacent edge rows, each of said spaces having one of three distinctly different space indicia, and said spaces being arranged such that no two adjacent spaces have the same said space indicia.

24. The game board of claim 23, wherein said space indicia are visually distinct colors.

* * * * *